US007334429B2

(12) United States Patent
Förster et al.

(10) Patent No.: US 7,334,429 B2
(45) Date of Patent: Feb. 26, 2008

(54) REFRIGERANT CONDENSER FOR MOTOR VEHICLE AIR-CONDITIONING SYSTEMS

(75) Inventors: Uwe Förster, Erdmannhausen (DE); Kurt Molt, Bietigheim-Bissingen (DE); Gerrit Wölk, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 268 days.

(21) Appl. No.: 10/525,322

(22) PCT Filed: Aug. 19, 2003

(86) PCT No.: PCT/EP03/09163

§ 371 (c)(1),
(2), (4) Date: Feb. 22, 2005

(87) PCT Pub. No.: WO2004/025196

PCT Pub. Date: Mar. 25, 2004

(65) Prior Publication Data

US 2006/0162375 A1 Jul. 27, 2006

(30) Foreign Application Priority Data

Aug. 31, 2002 (DE) ..... 102 40 302

(51) Int. Cl.
*F25B 39/04* (2006.01)

(52) U.S. Cl. ..... 62/509; 62/474

(58) Field of Classification Search ..... 62/474, 62/509, 503; 165/132

See application file for complete search history.

(56) References Cited

U.S. PATENT DOCUMENTS 5,386,629 A 2/1995 Ouchi et al.
5,546,761 A 8/1996 Matsuo et al.
5,628,206 A 5/1997 Baba
5,713,217 A 2/1998 Baba
5,752,566 A * 5/1998 Liu et al. ..... 165/110
5,813,249 A 9/1998 Matsuo et al.
5,884,503 A 3/1999 Inaba
5,934,102 A 8/1999 DeKeuster et al.
5,937,671 A 8/1999 Inoue et al.
5,946,940 A 9/1999 Inoue
6,052,899 A 4/2000 Inaba (Continued)

FOREIGN PATENT DOCUMENTS

CN 1232160 10/1999

(Continued)

OTHER PUBLICATIONS

Sofia Borislaw Jontschev, "Einteilige Werkstucke durch Ruckwarts-FlieBpressen/Single-Piece C0omponents by Reverse Extruding", Werkstatt und Betrieb, May 1, 1993, pp. 275-277, vol. 126, No. 5.

*Primary Examiner*—Melvin Jones
(74) *Attorney, Agent, or Firm*—Foley & Lardner LLP

(57) ABSTRACT

The invention relates to a cooling agent condenser (1) which comprises a finned tube block (2), collecting tubes (5) arranged on both sides thereof and a manifold (6) which is disposed in a parallel position with respect to the collecting tube (5) and connected to a cooling agent and said collecting tube (5) by means of an overflow opening (8, 9). Said manifold is embodied in the form of a monoblock tube.

22 Claims, 6 Drawing Sheets

U.S. PATENT DOCUMENTS

Figure 1:
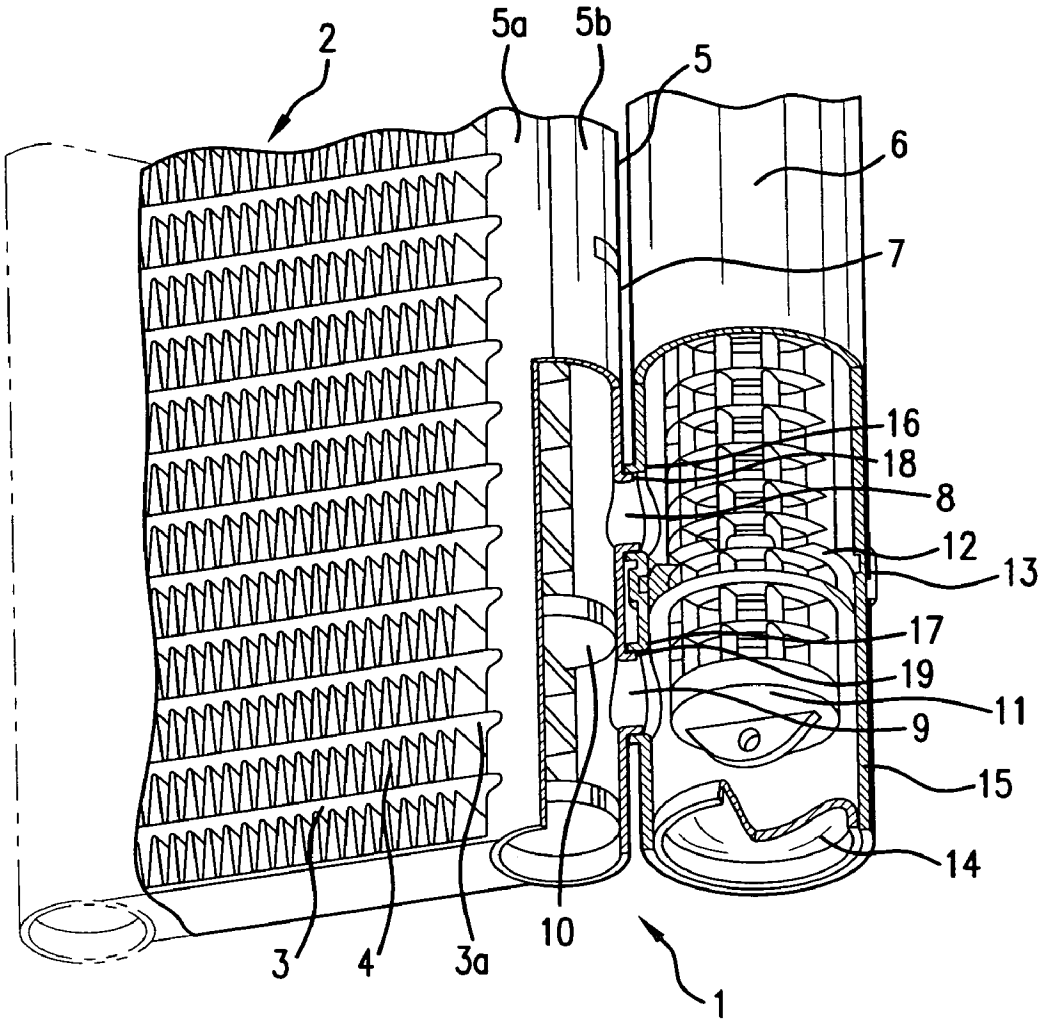

| | | | | |
|---|---|---|---|---|
| 6,223,556 | B1 | 5/2001 | De Keuster et al. | |
| 6,397,627 | B1 | 6/2002 | Aki et al. | |
| 6,446,714 | B1 | 9/2002 | Kaspar et al. | |
| 6,505,481 | B2 * | 1/2003 | Neumann et al. | 62/506 |
| 6,851,468 | B2 | 2/2005 | Kaspar et al. | |
| 2002/0083735 | A1 * | 7/2002 | Neumann et al. | 62/509 |

FOREIGN PATENT DOCUMENTS

| | | | |
|---|---|---|---|
| DE | 195 36 999 | A1 | 4/1996 |
| DE | 198 48 744 | A1 | 10/1998 |
| DE | 19815584 | A1 | 11/1998 |
| DE | 198 38 779 | A1 | 3/1999 |
| DE | 19849528 | C2 | 5/2000 |
| DE | 10010534 | A5 | 9/2000 |
| DE | 101 54 891 | | 11/2001 |
| EP | 0 795 730 | A1 | 9/1997 |
| EP | 0 833 117 | A2 | 4/1998 |
| EP | 0 841 105 | A2 | 5/1998 |
| EP | 0 936 423 | A2 | 8/1999 |
| EP | 1 310 748 | A2 | 5/2003 |
| JP | 7-103612 | A | 4/1995 |
| JP | 9-217966 | A | 8/1997 |
| JP | 10-300285 | A | 11/1998 |
| JP | 11-63732 | A | 3/1999 |
| JP | 11-294902 | A | 10/1999 |
| JP | 2001-33121 | A | 2/2001 |

* cited by examiner

REFRIGERANT CONDENSER FOR MOTOR VEHICLE AIR-CONDITIONING SYSTEMS

The invention relates to a refrigerant condenser, in particular for motor vehicle air-conditioning systems, consisting of a tube/rib block and header tubes arranged on at least one side or else on both sides, and also of a header which is arranged parallel to a header tube and which is in refrigerant connection with the header tube via overflow orifices, in particular according to the Applicant's older patent application DE 101 54 891.

The condenser disclosed in the older patent application DE 101 54 891 has a header which is composed of two parts, to be precise a tube piece and an extruded tubular profile. The overflow orifices which connect the header to the header tube are arranged in the profile piece and are designed as bores, into which engage rim holes which are shaped out of a cover part of a two-part header tube. The header tube and the header are fixed to one another by the insertion of the rim holes into the bores of the profile piece. An additional fixing of the two parts takes place by means of a common cover which holds the end faces of the header tube and header in the position in which the condenser is still to be maintained during the soldering process. The construction of the header from a welded tube and a profile piece signifies an increased outlay in terms of manufacture and of cost, because the profile piece incurs relatively high costs with regard to the outlay in terms of material, to production and to cutting machining.

The object of the present invention is to improve a condenser of the type initially mentioned, to the effect that the outlay in terms of manufacture and of cost and also the weight, in particular for the header and its connection to the header tube, are reduced.

The solution to this object arises from the features of patent claim 1; according to the solution, the header is formed as a one-piece tube. An essential advantage is, in the first place, that the production costs are markedly lower, because the entire header can be produced from a prefabricated part, for example a semifinished part, and consequently material and machining costs are reduced.

In an advantageous development of the invention, the tube may be designed as a welded, extruded or folded tube or be produced by reverse extrusion.

In a further advantageous refinement of the invention, in the region of the overflow orifices, rim holes, which are shaped out of the tube material and are preferably directed outward (toward the outside of the tube), are arranged on the header tube and/or on the tube of the header. The production of such rim holes entails comparatively low costs, since it is carried out by noncutting forming. The rim holes may have different diameters and engage one in the other telescopically or in a nested manner, that is to say either the rim holes of the header tube engage into the rim holes of the tube of the header or the rim holes of the tube are arranged within the rim holes of the header tube—in both cases, the rim holes overlap one another and form a common annular contact face where they are soldered to one another and thus form a leaktight overflow duct between the header and the header tube. At the same time, by the rim holes being plugged one into the other, a fixing of the header tube and the tube of the header takes place—the fixing of the two parts is necessary for the subsequent soldering process. Since the two parts are fixed to one another solely by the insertion of the rim holes, fixing by tacking (tack welding) may be dispensed with.

In a further advantageous refinement of the invention, an intermediate piece having bores in the region of the overflow orifices may be arranged between the header tube and the tube, these bores encasing the rim holes and consequently likewise providing the necessary contact face for soldering, this also resulting in leaktight overflow ducts between the header tube and tube. The joining of the two parts, that is to say the insertion of the rim holes into the bores of the intermediate piece, is already sufficient for fixing the header tube and tube. The bores may in this case be designed continuously or as stepped bores, in order to receive within them the rim holes or tabs.

In an advantageous development of the invention, the abovementioned rim holes may be substituted by a tube piece, this tube piece being plugged in each case into an orifice in the header tube and in the tube. The orifices in the tube and header tube are, for example, punched out, that is to say can be produced at low cost. The inserted tube piece advantageously has a continuous centrally arranged bead which serves as a stop when the tube piece is plugged into the plug-in orifices in the header tube and tube. This bead at the same time makes the clearance between the header tube and tube. Furthermore, the header tube and tube are sufficiently fixed to one another as a result of the attachment of this tube piece.

In a further advantageous refinement of the invention, overflow ducts between the tube and the header tube are formed by means of a connection piece which has bores in the region of the overflow orifices and which bears directly against the outer walls of the header tube and tube. In this case, only orifices which are arranged in alignment with the bores of the connection piece are punched out in the tube and in the header tube.

According to a further advantageous refinement of the invention, both the tube and the header tube have, in the region of the overflow orifices, outwardly directed press-out or shaped-out portions which form an end contact face, for example annular, via which the header tube and the tube are soldered to one another, so that overflow ducts are formed by means of direct materially integral connections of the header tube and tube.

Exemplary embodiments of the invention are illustrated in the drawing and are described in more detail below.

Figure 2:
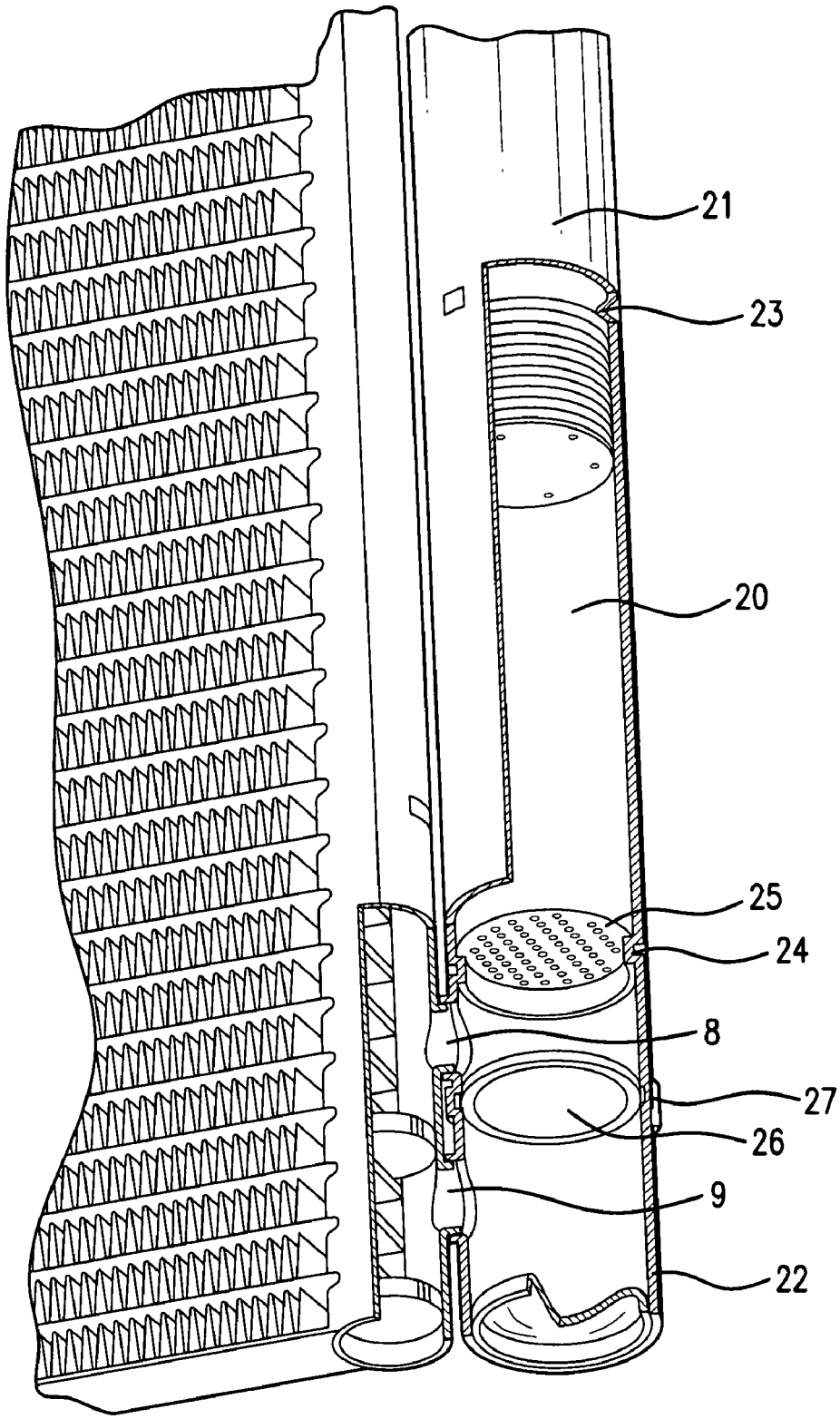
Figure 3:
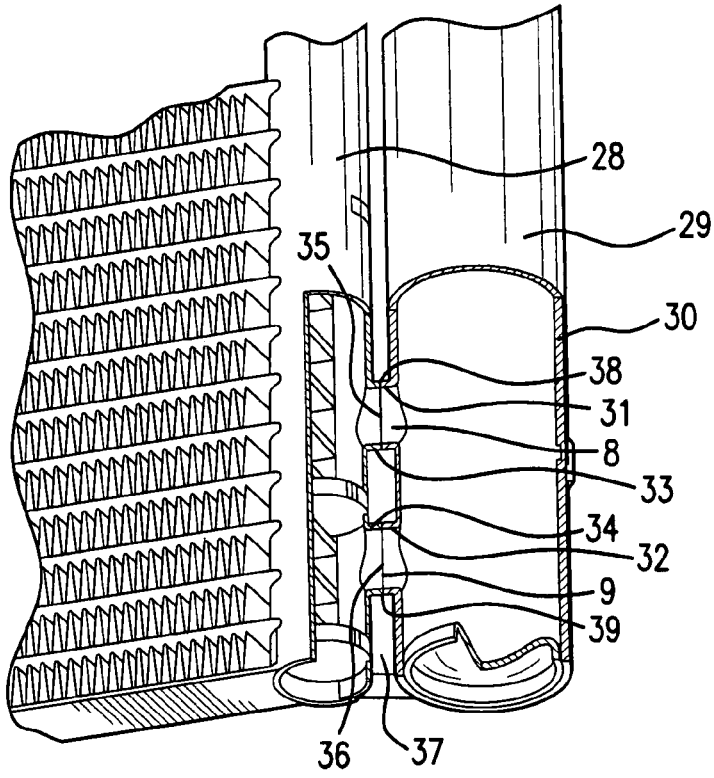
Figure 4:
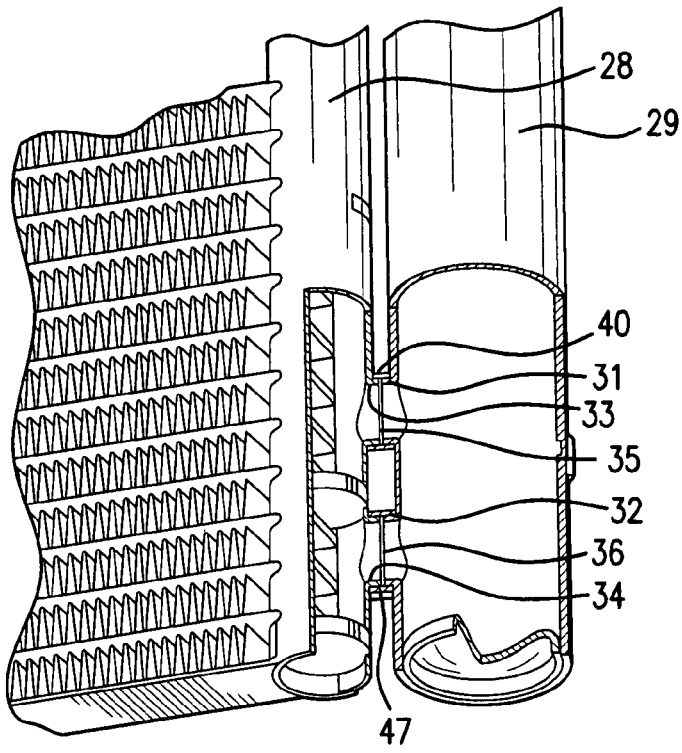
Figure 5:
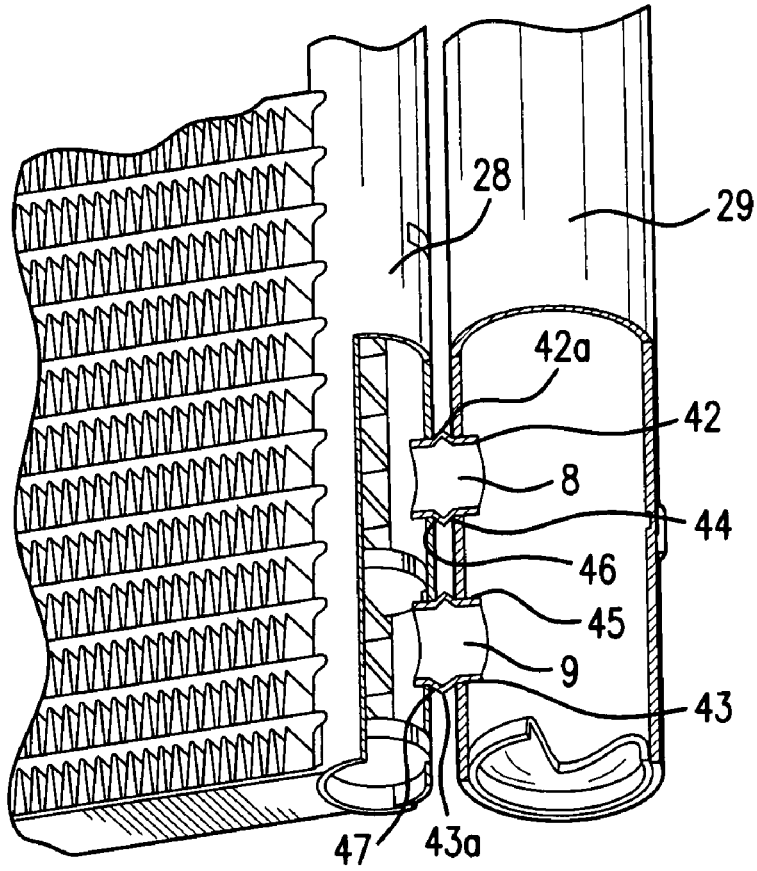
Figure 6:
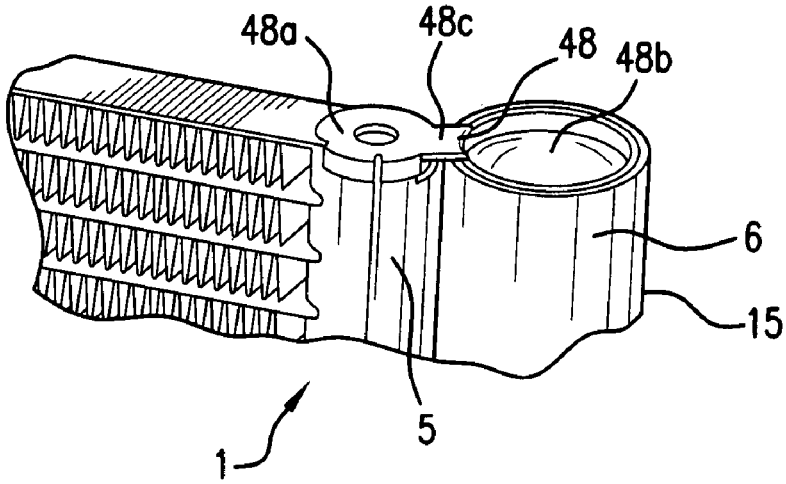
Figure 7:
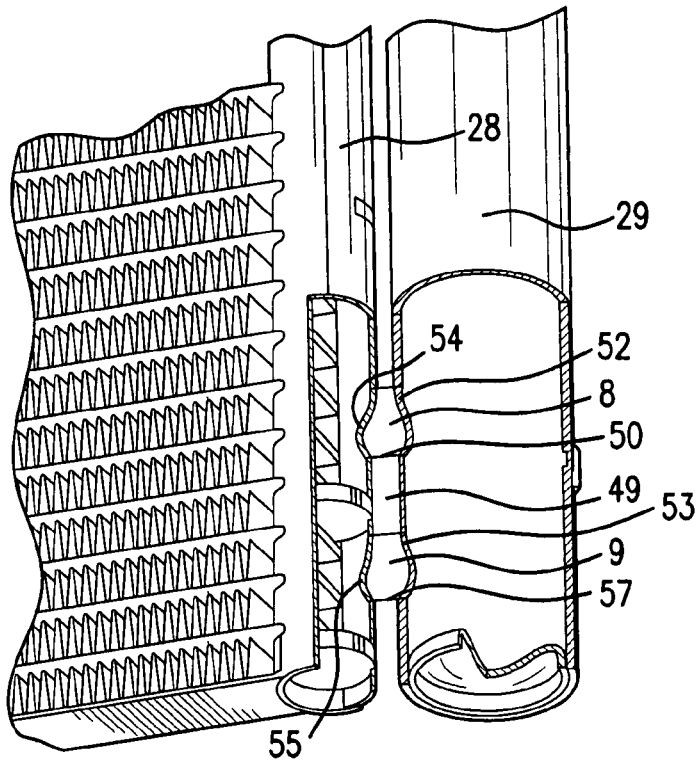
Figure 8:
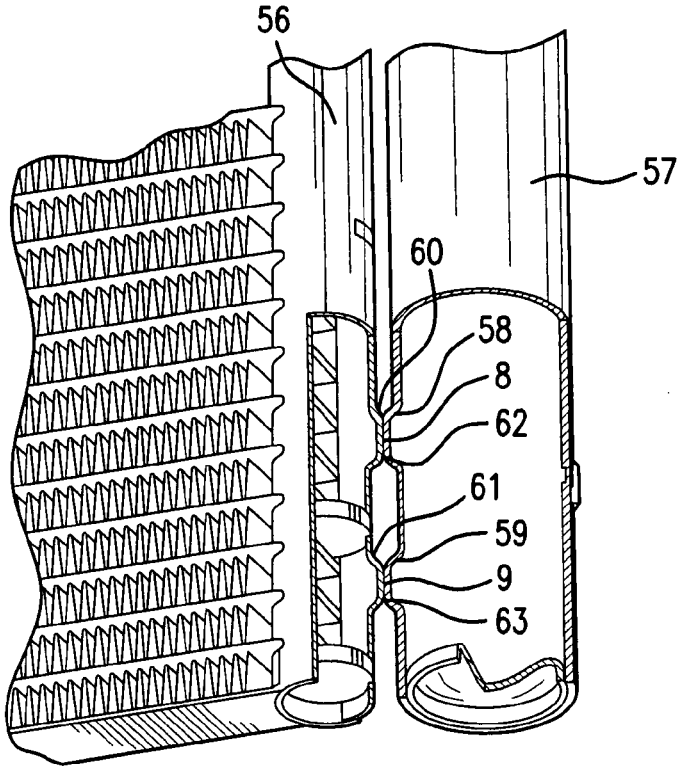

In the drawing:

FIG. 1 shows a detail of a condenser having a header tube and header with rim holes, FIG. 2 shows a condenser having a header tube and header with an integrated dryer/filter, FIG. 3 shows a second exemplary embodiment with rim holes and an intermediate piece, FIG. 4 shows a third exemplary embodiment with rim holes and a tubular sleeve, FIG. 5 shows a fourth exemplary embodiment with inserted tube pieces, FIG. 6 shows a common cover for a header tube and header, FIG. 7 shows a fifth exemplary embodiment with a connection piece, and FIG. 8 shows a sixth exemplary embodiment with shaped-out portions on the header tube and header.

Figure 9:
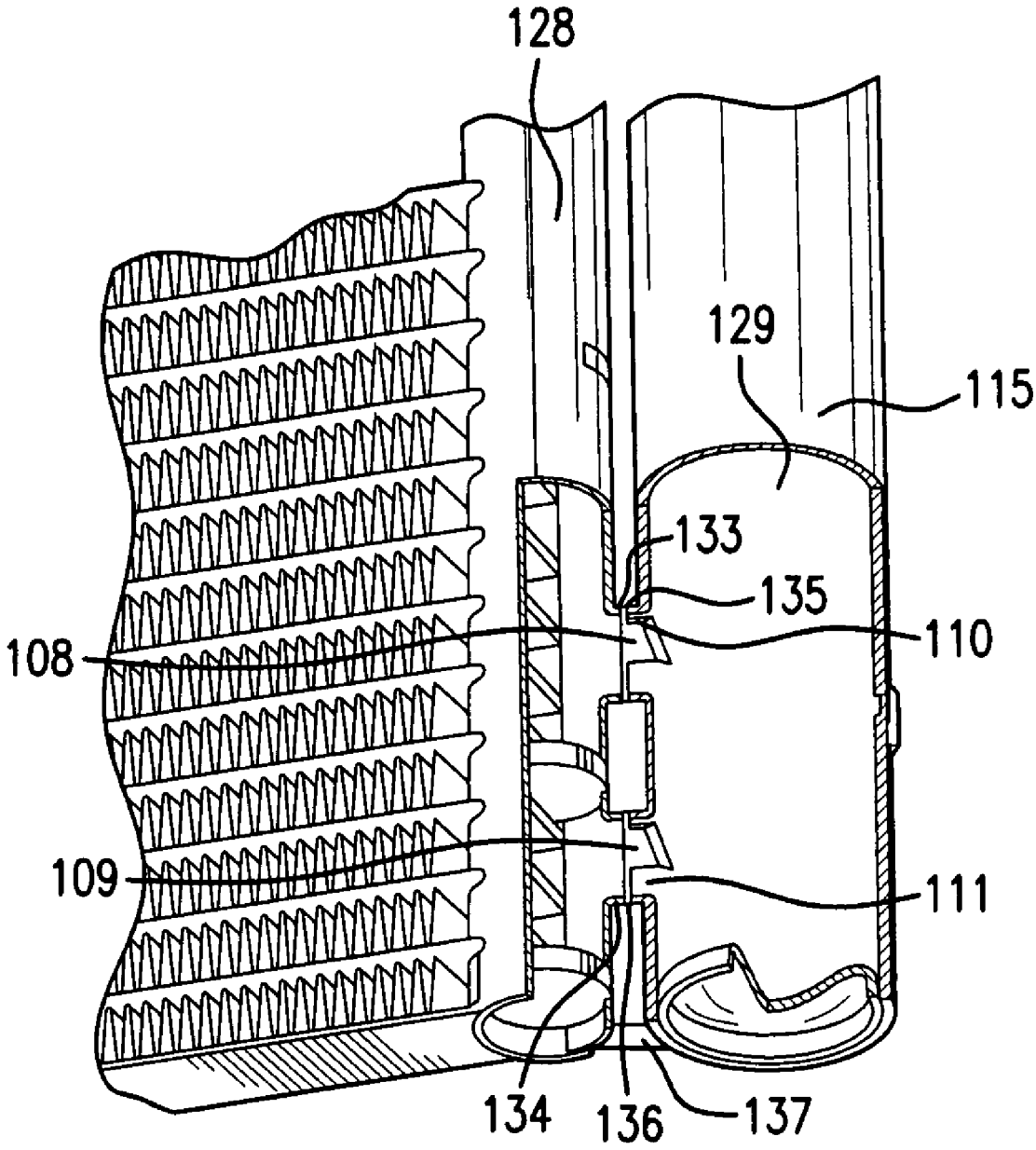

FIG. 9 shows a partially cut-away view illustrating another embodiment of the condenser according to the invention.

FIG. 1 shows a detail of a condenser 1 having a tube/rib block 2 which consists of flat tubes 3 and of corrugated ribs 4 arranged between these. The ends of the flat tubes 3 issue into header tubes, the header tube 5 is illustrated here, which is of two-part design and consists of a bottom part 5*a* receiving the tube ends and of a cover part 5*b*. A header (collector) 6 is arranged parallel to the header tube 5, a gap 7 being left between the header tube 5 and header 6. The header tube 5 and header 6 are in each case cut open in their lower region and reveal two overflow orifices 8, 9, via which the header tube 5 is connected fluidically to the header 6. A partition 10 is arranged in the header tube 5 between the two overflow orifices 8, 9. Reference is made, moreover, to the Applicant's older application DE 101 54 891, the entire disclosure content of which is incorporated into the subject of this Application. Inserted into the header 6 is a dryer/filter unit 11 which is fastened in a groove 13 of the header 6 by a holding means, such as for example, a continuous holding rib 12. The header 6 is closed downwardly by means of a cover 14; the header 6 is closed upwardly in a way not illustrated by means of a further releasable or non-releasable cover.

According to the invention, the header 6 is produced as a one-piece tube, here as a welded tube 15, that is to say from the lower cover 14 as far as the upper cover, not illustrated. Rim holes 16, 17 are shaped outward from the tube 15 in the region of the overflow orifices 8, 9. In a similar way, in the region of the overflow orifices 8, 9, outwardly directed rim holes 18, 19 are shaped out on the header tube 5, that is to say on the cover part 5*b,* and engage into the rim holes 16, 17 of the tube 15, that is to say are inserted telescopically into these, so that the pairs of rim holes 16/18 and 17/19 in each case form an adhesion fit with one another. The header 6 and header tube 5 are sufficiently fixed relative to one another by means of this adhesion fit and can be soldered in this position. Soldering in the region of the overflow orifices 8, 9 takes place via contact faces which are formed with one another by means of the pairs of rim holes 16/18 and 17/19. Fluidtight overflow ducts 8, 9 are thereby provided, without additional parts being required.

The drawing does not illustrate a variant of the configuration of the overflow orifices 8, 9, in which the rim holes likewise engage one in the other, but in the opposite way to that illustrated in FIG. 1, that is to say the rim holes of the header 6 engage into the rim holes of the header tube 5, hence have a smaller cross section than that of the header tube 5.

FIG. 2 shows a modified exemplary embodiment with the same design of the overflow orifices 8, 9 as illustrated in FIG. 1, that is to say with rim holes engaging one in the other. What is different in this exemplary embodiment is the design of the dryer 20 (dryer granulate not illustrated) which is integrated into the header 21 which consists of a welded tube 22. This integration takes place essentially in that the dryer is arranged between an upper bead or bead elements 23 and a lower continuous bead 24. The dryer 20 is delimited downwardly by a perforated plate 25. An annular sieve 26 is arranged and fixed in a groove 27 between the two overflow orifices 8, 9. The welded tube 22 thus affords the possibility that continuous beads 24, bead segments or depressions 23 or annular grooves 27 can be introduced into the tube 22 by means of noncutting forming, specifically without any particular outlay in production terms.

FIG. 3 shows a second exemplary embodiment of the configuration of the overflow orifices 8, 9 between a header tube 28 and a header 29 which, again, is designed as a one-piece welded or folded tube 30. Rim holes 31, 32 are shaped outward from the tube 30 in the region of the overflow orifices 8, 9. In the same way, that is to say with the same cross section, rim holes 33, 34 are likewise shaped outward from the header tube 28 (from the cover part of the latter), so that the rim holes 31, 32 of the tube 30, together with the rim holes 33, 34 of the header tube 28, form in each case a butt joint 35, 36. Arranged between the header tube 28 and header 29, in the region of the overflow orifices 8, 9, is an intermediate piece 37 which, in the region of the overflow orifices 8, 9, has bores 38, 39 into which the rim holes 31, 32 and 33, 34 engage from both sides. In each case, between the bores 38, 39 and the outer circumference of the rim holes 31, 32; 33, 34, a contact face is consequently provided, via which soldering takes place, so that, again, fluidtight overflow ducts 8, 9 are provided between the header tube 28 and the header 29.

FIG. 4 shows a third exemplary embodiment, similar to that illustrated in FIG. 3, that is to say with rim holes 31, 32, 33, 34 which in each case form a butt joint 35, 36. The rim holes 31/33 and 32/34 butting onto one another are encased on their outer faces by tubular sleeves 40, 41, so that the butt joint 35, 36 is covered by the tubular sleeves 40, 41. This results, on the outside of the rim holes and on the inside of the tubular sleeves, in contact faces, via which soldering can take place and consequently leaktight overflow ducts can be provided between the header tube 28 and the header 29.

In a further exemplary embodiment, the rim holes of the header and of the header tube butt onto one another, within the rim holes tubular sleeves being introduced which are in each case connected, such as soldered, to the inner faces of the rim holes.

FIG. 5 shows a fourth exemplary embodiment of the design of the overflow orifices 8, 9 by means of inserted tube pieces 42, 43 which form overflow ducts between the header tube 28 and the header 29. The latter have plug-in orifices 44, 45 and 46, 47 which are produced, for example, by hole punching. The tube pieces 42, 43 have in each case a continuous outwardly directed bead 42*a,* 43*a* which is arranged in their center and which serves as a stop and as a spacer when the tube pieces 42, 43 are plugged into the plug-in orifices 44 to 47. The annular gap between the tube pieces 42, 43 and the plug-in orifices 44 to 47 is soldered, leaktight, during the soldering of the entire condenser.

FIG. 6 shows an upper detail of the condenser 1 with a header tube 5 and header 6 which, as mentioned, is designed as a one-piece tube 15. The header tube 5 and header 6 are closed on their upper end faces by means of a common cover 48. A detailed description of such a cover 48 is described in the abovementioned older patent application bearing the file number 101 54 891.5. This common cover 48 also serves as a fixing aid, in order to position the header tube 5 and header 6 with respect to one another in addition to the fixing means already mentioned above. In order to fulfill this task, the cover 48 has a cap-shaped part 48*a,* which engages over the end face of the header tube 5, and a cover insert 48*b,* which is inserted positively into the end face of the header 6. The two parts 48*a,* 48*b* are connected to one another by means of a web 48*c.* This results, for fixing the header tube 5 and header 6, in two fixing means, to be precise in the region-of the overflow orifices 8, 9 and in the upper part of the header 6 by means of the common cover 48.

FIG. 7 shows a fifth exemplary embodiment of the design of the overflow orifices 8, 9 by means of a connection piece 49 which is arranged between the header tube 28 and header 29 and which has passage bores 50, 51 in the region of the overflow orifices 8, 9. The connection piece 49 may be produced as an extruded profile with a cross section which is adapted to the outer contours of the header tube 28 and header 29, thus providing a sufficient contact face for soldering. The header 29 and the header tube 28 have, in the region of the overflow orifices 8, 9, punched-out orifices 52, 53 and 54, 55 which are in alignment with the passage bores 50, 51.

FIG. 8 shows a sixth exemplary embodiment of the design of the overflow orifices 8, 9 between the header tube 56 and the header 57. The overflow orifices 8, 9 are formed by outwardly directed pressed-out portions or shaped-out portions 58, 59 and 60, 61 which have an approximately frustoconical design and which are flattened on their outer end face into an annular face 62, 63 which serves as a contact face for soldering. The shaped-out portions 58 to 61 can be produced in a noncutting manner, that is to say by hole punching and pressing, without any outlay in manufacturing terms.

All the abovementioned exemplary embodiments are produced in that, first, the header tube and header are joined together and consequently fixed to one another—subsequently, the entire condenser is introduced into a soldering furnace and soldered "in one go". As a result of this soldering process, leaktight overflow ducts are provided in the region of the overflow orifices between the header tube and header.

FIG. 9 shows a second exemplary embodiment of the configuration of the overflow orifices 108, 109 between a header tube 128 and a header 129 which, again, is designed as a one-piece welded or folded tube 115. Tabs 110, 111 are shaped outward from the tube 115 in the region of the overflow orifices 108, 109. Rim holes 133, 134 are likewise shaped outward from the header tube 128, so that the tabs 110, 111 of the tube 115, together with the rim holes 133, 134 of the header tube 128, form in each case a butt joint 135, 136. Arranged between the header tube 128 and header 129, in the region of the overflow orifices 108, 109, is an intermediate piece 137 having bores, into which the rim holes 133, 134 or the tabs 110, 111 engage from both sides. This gives rise in each case, between the bores in the intermediate piece 137 and the outer circumference of the rim holes 133, 134 or tabs 110, 111, to a contact face, via which soldering takes place, so that, again, fluidtight overflow ducts 108, 109 are provided between the header tube 128 and the header 129.

REFERENCE SYMBOLS

1 Condenser
2 Tube/rib block
3 Flat tube
4 Corrugated rib
5 Header tube
5*a* Bottom part
5*b* Cover part
6 Header
7 Gap
8 Overflow orifice
9 Overflow orifice
10 Partition
11 Dryer/filter unit
12 Holding rib
13 Groove
14 Cover
15 Tube
16 Rim hole (tube)
17 Rim hole (tube)
18 Rim hole (header tube)
19 Rim hole (header tube)
20 Dryer
21 Header
22 Tube
23 Bead
24 Bead
25 Perforated plate
26 Annular sieve
27 Groove
28 Header tube
29 Header
30 Tube
31 Rim hole (tube)
32 Rim hole (tube)
33 Rim hole (header tube)
34 Rim hole (header tube)
35 Butt joint
36 Butt joint
37 Intermediate piece
38 Bore
39 Bore
40 Tubular sleeve
41 Tubular sleeve
42 Tube piece
42*a* Bead
43 Tube piece
43*a* Bead
44 Plug-in orifice
45 Plug-in orifice
46 Plug-in orifice
47 Plug-in orifice
48 Cover
48*a* Cap-shaped part
48*b* Cover insert
48*c* Web
49 Connection piece
50 Passage bore
51 Passage bore
52 Orifice (tube)
53 Orifice (tube)
54 Orifice (header tube)
55 Orifice (header tube)
56 Header tube
57 Header
58 Shaped-out portion (tube)
59 Shaped-out portion (tube)
60 Shaped-out portion (header tube)
61 Shaped-out portion (header tube)
62 Annular face
63 Annular face

The invention claimed is:

1. A refrigerant condenser for a motor vehicle air-conditioning system, comprising:

a tube/rib block;

at least one header tube arranged on one side or header tubes arranged on both sides; and also a header which is arranged parallel to a header tube and which is in refrigerant connection with the header tube via overflow orifices and is designed as a one-piece tube, wherein the overflow orifices are designed as rim holes which form overflow ducts.

2. The condenser as claimed in claim 1, wherein the tube is designed as a welded tube.

3. The condenser as claimed in claim 1, wherein the tube is produced by extrusion.

4. The condenser as claimed in claim 1, wherein the tube is designed as a folded tube.

5. The condenser as claimed in claim 1, wherein the tube is produced by reverse extrusion.

6. The condenser as claimed in claim 1, wherein the rim holes are arranged on the tube of the header and are directed outward.

7. The condenser as claimed in claim 1, wherein the rim holes are arranged on the header tube and are directed inward or outward.

8. The condenser as claimed in claim 1, wherein the rim holes of the tube and header tube have different cross sections in size and are designed to engage telescopically one into the other.

9. The condenser as claimed in claim 1, wherein the rim holes of the tube and header tube are arranged so as to butt onto one another and, in particular, have an identical end cross section.

10. The condenser as claimed in claim 9, wherein the rim holes are encased in each case by a tubular sleeve.

11. The condenser as claimed in claim 9, wherein the rim holes receive a sleeve radially on the inside.

12. The condenser as claimed in claim 9, wherein the overflow orifices are provided with tabs which point out of the header tube and/or tube.

13. The condenser as claimed in claim 9, wherein between the header tube and tube is arranged at least one intermediate piece with bores which receive the rim holes or tabs, the bores being designed, in particular, continuously or as stepped bores.

14. The condenser as claimed in claim 1, wherein the overflow orifices are designed as tubular pieces which are inserted into plug-in orifices arranged in the tube and header tube and which form overflow ducts.

15. The condenser as claimed in claim 12, wherein the tubular pieces have a bead arranged approximately centrally and between the header tube and tube.

16. The condenser as claimed in claim 1, wherein the overflow orifices are formed by passage bores in a connection piece which is arranged between the tube and header tube.

17. The condenser as claimed in claim 1, wherein the overflow orifices are formed by outwardly directed shaped-out portions arranged on the tube and on the header tube and having a preferably annular contact face.

18. The condenser as claimed in claim 1, wherein the tube and header tube are fixed to one another by joining.

19. The condenser as claimed in claim 14, wherein the header tube and the tube and also the connection piece are fixed to one another by tacking.

20. The condenser as claimed in claim 1, wherein the overflow orifices are formed by a plurality of parallel-connected individual orifices.

21. The condenser as claimed in claim 1, wherein the header tube is of two-part design and has a bottom part for receiving the tube ends and a cover part in which the overflow orifices are arranged.

22. The condenser as claimed in claim 1, wherein the header tube and tube are additionally fixed to one another by means of at least one common cover.

* * * * *